US008212167B2

(12) United States Patent
Chen

(10) Patent No.: US 8,212,167 B2
(45) Date of Patent: Jul. 3, 2012

(54) DEPRESSIBLE KEY STRUCTURE

(75) Inventor: Bo-An Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 328 days.

(21) Appl. No.: 12/692,908

(22) Filed: Jan. 25, 2010

(65) Prior Publication Data

US 2011/0114461 A1 May 19, 2011

(30) Foreign Application Priority Data

Nov. 13, 2009 (TW) ..... 98138663 A

(51) Int. Cl.
*H01H 13/70* (2006.01)

(52) U.S. Cl. ..... 200/345; 200/344

(58) Field of Classification Search ..... 200/5 A, 200/296, 341, 344, 345, 517, 520; 400/490–496
See application file for complete search history.

(56) References Cited

U.S. PATENT DOCUMENTS 4,638,151 A * 1/1987 Suwa ..... 235/145 R
6,160,232 A * 12/2000 Lin ..... 200/341
6,936,782 B2 * 8/2005 Ito ..... 200/344
7,645,955 B2 * 1/2010 Huang et al. ..... 200/341
8,044,315 B2 * 10/2011 Lin et al. ..... 200/345
2007/0144885 A1 * 6/2007 Nakatani et al. ..... 200/520
2009/0038922 A1 * 2/2009 Wang ..... 200/344
2009/0178912 A1 * 7/2009 Chen ..... 200/5 A
2010/0084251 A1 * 4/2010 Rajagopal et al. ..... 200/5 A
2011/0036693 A1 * 2/2011 Lin et al. ..... 200/314
2011/0062007 A1 * 3/2011 Mao et al. ..... 200/345

* cited by examiner

*Primary Examiner* — Michael Friedhofer

(74) *Attorney, Agent, or Firm* — Kirton McConkie; Evan R. Witt

(57) ABSTRACT

A depressible key structure includes a key frame, a keycap, and plural elastic arms. The key frame has a receiving hole. The keycap is accommodated within the receiving hole, and includes plural outer corner portions. Each of the elastic arms includes an inner fixed arm part, at least one outer movable arm part, and a corner transition part interconnected between the inner fixed arm part and the at least one outer movable arm part. The corner transition parts of the elastic arms correspond to respective outer corner portions of the keycap. Each of the inner fixed arm parts is positioned at an inner edge of a specified side of a bottom surface of the keycap. A corresponding corner transition part is protruded out of the specified side to an adjacent side along a corresponding outer corner portion. The outer movable arm part is fixed on the key frame.

9 Claims, 4 Drawing Sheets

DEPRESSIBLE KEY STRUCTURE

FIELD OF THE INVENTION

The present invention relates to a key structure, and more particularly to a flat depressible key structure.

BACKGROUND OF THE INVENTION

Recently, the general trends in designing computers and their peripheral devices are toward small size, light weightiness and easy portability. Take keyboards for example. The manufacturers of the keyboards are devoted to the study of designing slim keyboards in order to minimize the size thereof. In addition, the demands on enhancing comfort of the key structure and properly controlling the depressing force are gradually increased.

Nowadays, the slim keyboard used in for example a notebook computer usually has a scissors-type support member for support the key structure. FIG. 1 is a schematic cross-sectional view illustrating a key structure with a scissors-type support member according to the prior art. As shown in FIG. 1, the key structure comprises a keycap 71, a rubbery elastomeric element 72, a scissors-type support member 60 and a base plate 74. The scissors-type support member 60 comprises inner support arms 61 and outer support arms 62. A lever structure with fulcrums is formed between the inner support arms 61 and the outer support arms 62. By the upper fixing parts 75 of the keycap 71 and the lower fixing parts 76 of the base plate 74, the scissors-type support member 60 is pivotally fixed between the keycap 71 and the base plate 74. In a case that a downward force is exerted on the keycap 71, the keycap 71 is moved downwardly in the vertical direction under the guiding action of the scissors-type support member 60. As such, the rubbery elastomeric element 72 is pressed and subject to deformation. In a case that the downward force exerted on the keycap 71 is eliminated, an elastic restoring force is provided by the rubbery elastomeric element 72. Due to the elastic restoring force, the keycap 71 is returned to its original position. Since the key structure with the scissors-type support member has many pivotal parts, the upper fixing parts 75 and the lower fixing parts 76, the process of assembling the key structure is very troublesome. In addition, since the components of the key structure are complicated and diversified, the fabricating cost of the key structure is very high. The scissors-type support member 60 is operated according the principle of leverage. Due to the limitations of the plastic molding technology, the lever fulcrums and the lever arms (e.g. the inner support arms 61 and the outer support arms 62) of the scissors-type support member 60 become hindrance from reducing the overall height of the key structure. In other words, when the key structure with the scissors-type support member is used in a notebook computer, the notebook computer fails to meet the requirements of small size, light weightiness and easy portability small size, light weightiness and easy portability.

SUMMARY OF THE INVENTION

An object of the present invention provides a depressible key structure with cost effectiveness, simplified configurations and reduced height.

In accordance with an aspect of the present invention, there is provided a depressible key structure. The depressible key structure includes a key frame, a keycap, and plural elastic arms. The key frame has a receiving hole. The keycap is accommodated within the receiving hole, and includes plural outer corner portions. Each of the elastic arms includes an inner fixed arm part, at least one outer movable arm part, and a corner transition part interconnected between the inner fixed arm part and the at least one outer movable arm part. The corner transition parts of the elastic arms correspond to respective outer corner portions of the keycap. Each of the inner fixed arm parts is positioned at an inner edge of a specified side of a bottom surface of the keycap. A corresponding corner transition part is protruded out of the specified side to an adjacent side along a corresponding outer corner portion. The outer movable arm part is fixed on the key frame.

In an embodiment, the keycap is square-shaped, and the depressible key structure includes two elastic arms. Each of the elastic arms includes an inner fixed arm part, two outer movable arm parts disposed at bilateral sides of the inner fixed arm part and perpendicular to the inner fixed arm part, a first corner transition part interconnected between the inner fixed arm part and one outer movable arm part, and a second corner transition part interconnected between the inner fixed arm part and the other outer movable arm part. The inner fixed arm parts of the two elastic arms are respectively positioned at inner edges of two opposite sides of the bottom surface of the keycap. The outer movable arm parts of the two elastic arms are close to outer edges of corresponding sides of the bottom surface of the keycap.

In an embodiment, distal ends of the two outer movable arm parts at the same side are spaced from each other by a spacing interval.

In an embodiment, a middle retaining hole and two lateral retaining holes are formed in the inner fixed arm part of each elastic arm. A middle retaining post and two lateral retaining posts are formed on the bottom surface of the keycap at the side corresponding to the inner fixed arm part. The middle retaining hole and the lateral retaining holes are respectively engaged with the middle retaining post and the lateral retaining posts.

In an embodiment, a fret slot not running through a top surface of the key frame is extended from an outer periphery of the receiving hole and formed in a bottom of the key frame. A slot wall is defined at a backside of the top surface of the key frame. Distal ends of the outer movable arm part are fixed on the slot wall.

In an embodiment, the elastic arms are flat and stripe-shaped.

In an embodiment, from top to bottom, the depressible key structure further includes an elastomeric element, a conductive membrane and a base plate. A recess is formed in a middle and backside of the keycap. A bottom of the elastomeric element is disposed on the conductive membrane. A top of the elastomeric element is positioned in a middle of the recess. The key frame is fixed with respect to the base plate.

In an embodiment, the elastomeric element is a rubbery depressible body.

In an embodiment, an asterisk convex part is formed on the middle of the recess, an open trench is formed in the top of the elastomeric element, and the asterisk convex part is accommodated within the open trench.

In an embodiment, the bottom of the elastomeric element is fixed on the conductive membrane.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a flat depressible key structure. The present invention will now be described more specifically with reference to the following drawings and embodiments.

Figure 1:
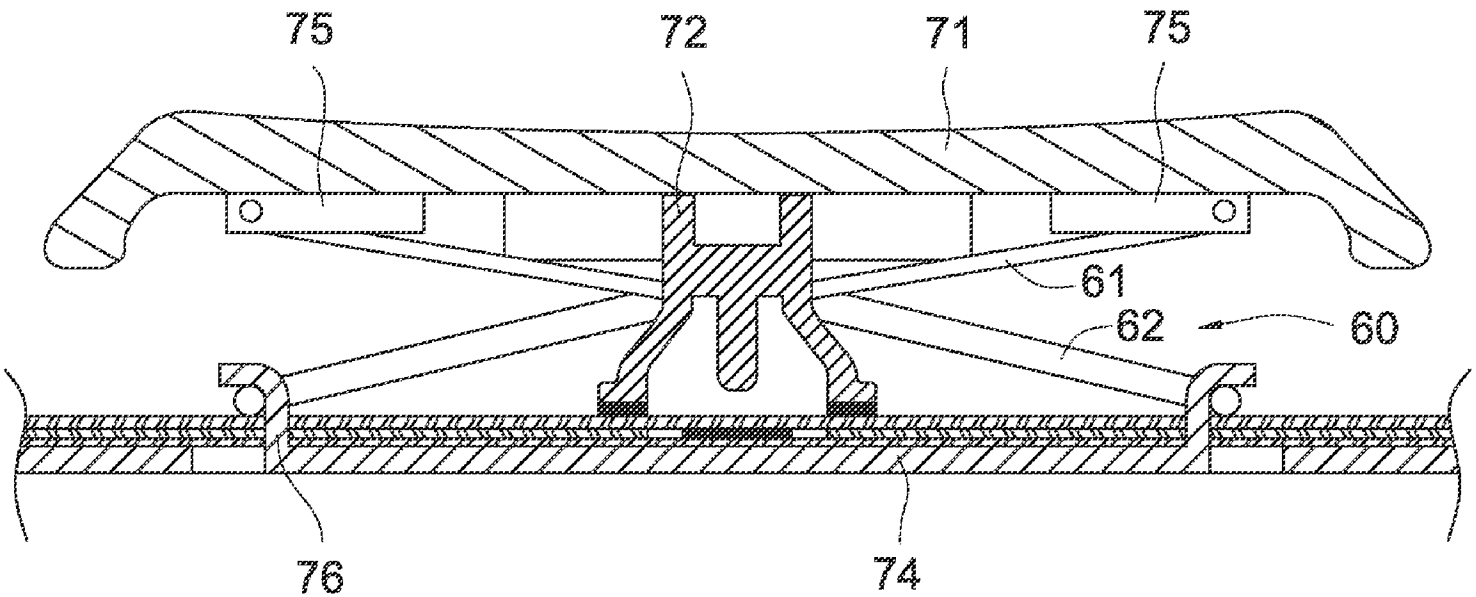
FIG. 1(PRIOR ART)
FIG. 1 is a schematic cross-sectional view illustrating a key structure with a scissors-type support member according to the prior art.
Figure 2:
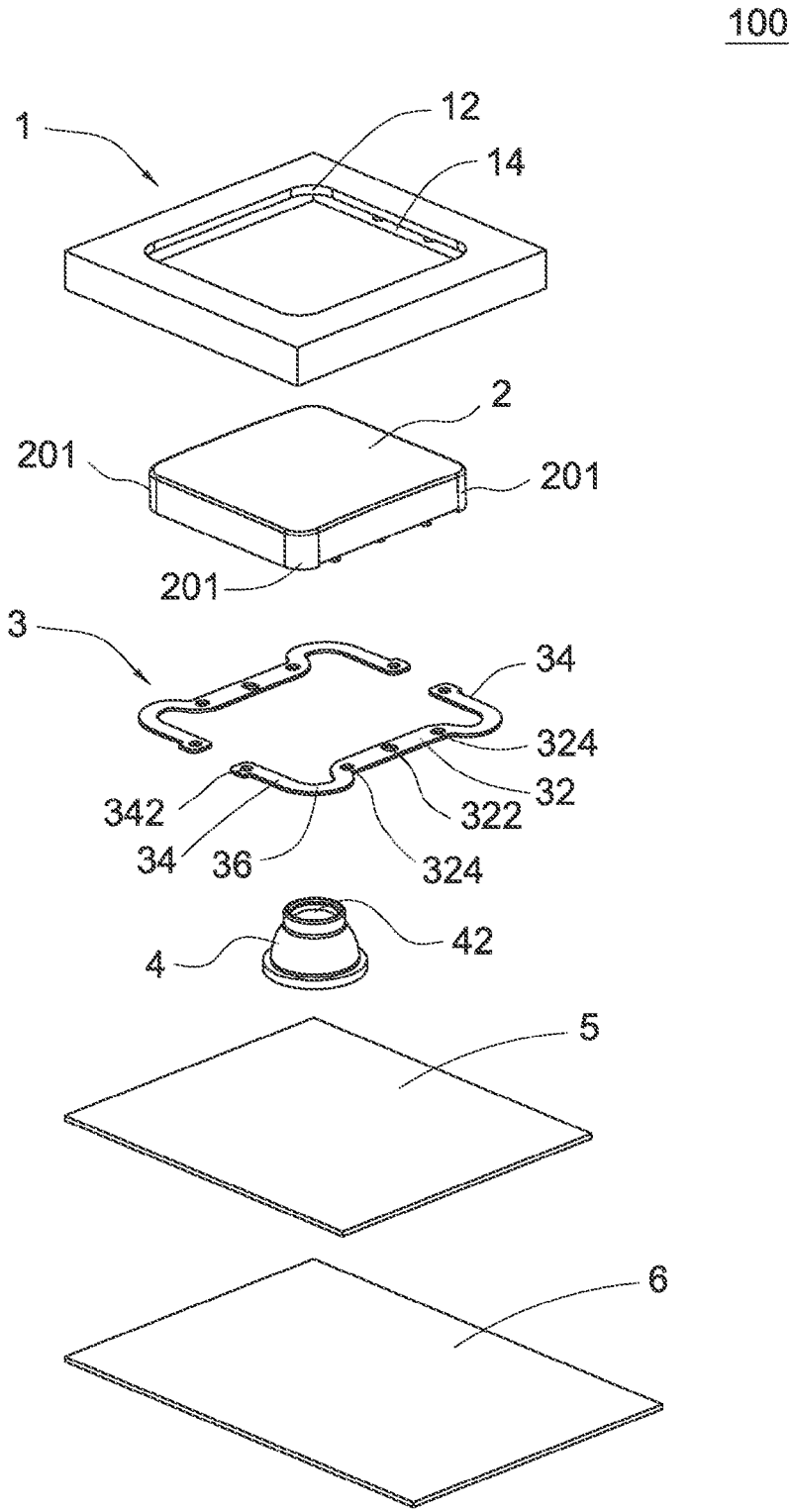
FIG. 2 is a schematic exploded view illustrating a depressible key structure according to a first embodiment of the present invention.

The depressible key structure of the present invention is not limited to be applied to a keyboard of a computer. For example, the depressible key structure is applied to a keyboard of a notebook computer. FIG. 2 is a schematic exploded view illustrating a depressible key structure according to a first embodiment of the present invention. As shown in FIG. 2, the depressible key structure 100 comprises a key frame 1, a keycap 2, two elastic arms 3, an elastomeric element 4, a conductive membrane 5 and a base plate 6.

Figure 6:
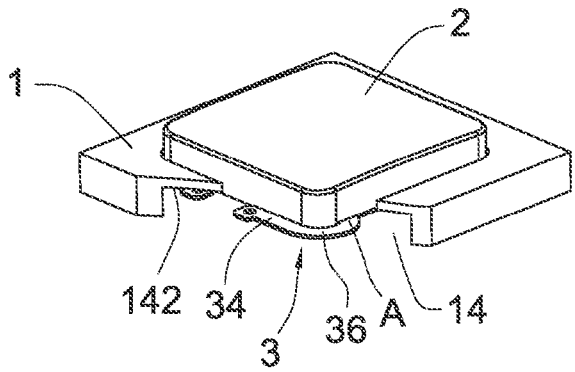
FIG. 6 is a schematic cutaway view illustrating an assembled depressible key structure according to the first embodiment of the present invention that is not depressed.

FIG. 6 is a schematic cutaway view illustrating an assembled depressible key structure that is not depressed according to the first embodiment of the present invention. Please refer to FIGS. 2 and 6. The key frame 1 is a square frame with a specified thickness. The key frame 1 has a central square receiving hole 12 running through the top and bottom surfaces thereof. The square receiving hole 12 may accommodate the keycap 2. In addition, a fret slot 14 not running through the top surface of the key frame 1 is extended from the outer periphery of the receiving hole 12 and formed in the bottom of the key frame 1. As such, a slot wall 142 is defined at the backside of the top surface of the key frame 1.

Figure 3:
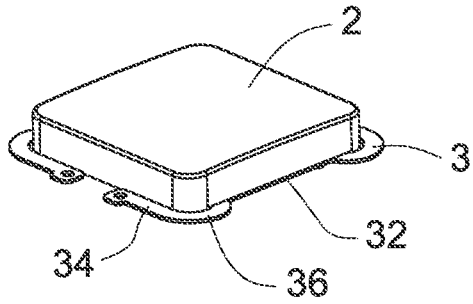
FIG. 3 is a schematic assembled view illustrating the combination of the keycap and the elastic arms of the depressible key structure according to the first embodiment of the present invention.
Figure 4:
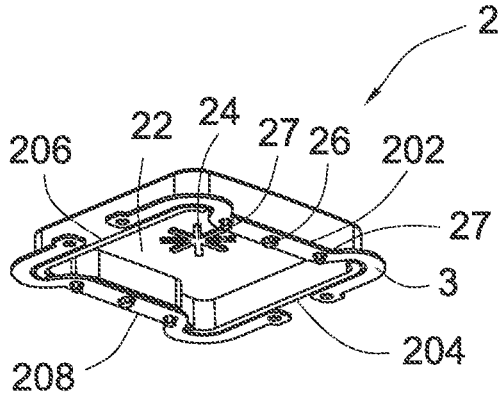
FIG. 4 is a schematic assembled view illustrating the combination of the keycap and the elastic arms of the depressible key structure that are taken from another viewpoint.
Figure 5:
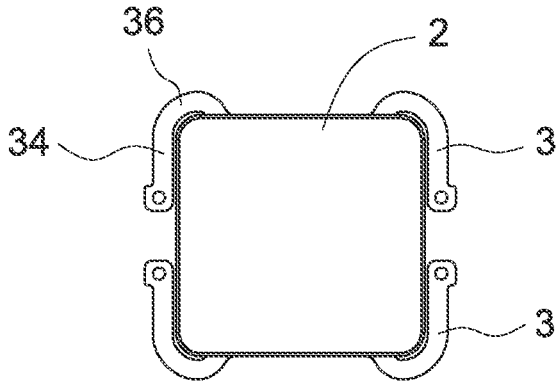
FIG. 5 is a schematic planar view illustrating the depressible key structure of FIG. 2.

FIG. 3 is a schematic assembled view illustrating the combination of the keycap and the elastic arms of the depressible key structure 100 according to the first embodiment of the present invention. FIG. 4 is a schematic assembled view illustrating the combination of the keycap and the elastic arms of the depressible key structure 100 that are taken from another viewpoint. FIG. 5 is a schematic planar view illustrating the depressible key structure of FIG. 2. The keycap 2 is a symmetric square block with a specified thickness. In addition, the keycap 2 includes four outer corner portions 201 (see FIG. 2). A square recess 22 is formed in the middle and backside of the keycap 2. An asterisk convex part 24 is formed on the middle of the recess 22. The bottom surface of the keycap 2 includes a first side 202, a second side 204, a third side 206 and a fourth side 208. The second side 204 and the third side 206 are adjacent to the first side 202. The fourth side 208 is opposed to the first side 202. The first side 202 and the fourth side 208 have the same length. The second side 204 and the third side 206 have the same length. A middle retaining post 26 and two lateral retaining posts 27 are formed on the first side 202 of the bottom surface of the keycap 2. Similarly, another middle retaining post 26 and the other two lateral retaining posts 27 are formed on the fourth side 208 of the bottom surface of the keycap 2.

Please refer to FIGS. 2 and 4 again. The elastic arms 3 are flat and stripe-shaped. Each of the elastic arms 3 comprises an inner fixed arm part 32, two outer movable arm parts 34 and two corner transition parts 36. The outer movable arm parts 34 are disposed on two opposite sides of the inner fixed arm part 32 and substantially perpendicular to the inner fixed arm part 32. The corner transition parts 36 are interconnected between the inner fixed arm part 32 and a corresponding outer movable arm part 34. The elastic arm 3 is symmetric with respect to the perpendicular bisector of the inner fixed arm part 32. The distance between the distal ends of the two outer movable arm parts 34 at two opposite sides of the inner fixed arm part 32 is slightly greater than the length of the first side 202 or the fourth side 208 of the key frame 2. Of course, the distance between the distal ends of the two outer movable arm parts 34 may be extended as required. A middle retaining hole 322 and two lateral retaining holes 324 are formed in the inner fixed arm part 32 of each elastic arm 3. The middle retaining posts 26 and the lateral retaining posts 27 of the first side 202 and the fourth side 208 of the keycap 2 are inserted into corresponding middle retaining holes 322 and lateral retaining holes 324 of the elastic arms 3. In addition, connecting holes 342 are formed in both distal ends of the two outer movable arm parts 34 of each elastic arm 3.

Hereinafter, a process of assembling the elastic arms 3, the key frame 1 and the keycap 2 will be illustrated with reference to FIGS. 3, 4, 5 and 6. First of all, the middle retaining hole 322 and the two lateral retaining holes 324 of the inner fixed arm part 32 of an elastic arm 3 are respectively sheathed around the middle retaining post 26 and the lateral retaining posts 27 of the first side 202 of the bottom surface of the keycap 2. As such, the inner fixed arm part 32 is positioned at the inner edge of the first side 202 of the bottom surface of the keycap 2, but the outer movable arm parts 34 on two opposite sides of the inner fixed arm part 32 are exposed outside the outer edges of the second side 204 and the third side 206. Next, the inner fixed arm part 32 of the other elastic arm 3 is positioned at the inner edge of the fourth side 208 of the bottom surface of the keycap 2, but the outer movable arm parts 34 on two opposite sides of the inner fixed arm part 32 are exposed outside the outer edges of the second side 204 and the third side 206 that are adjacent to the fourth side 208 (see FIG. 5). The distal ends of the two outer movable arm parts 34 at the same side are spaced from each other by a spacing interval.

In some embodiments, the distal ends of the two outer movable arm parts 34 just in contact with each other but are not superimposed with each other. After the keycap 2 is embedded into the receiving hole 12 of the key frame 1 from bottom to top, the distal ends of the two outer movable arm parts 34 at the second side 204 and the third side 206 are fixed on the slot wall 142 at the backside of the top surface of the key frame 1 through the connecting holes 342.

Please refer to FIG. 2 again. The elastomeric element 4 is a rubbery depressible body. The bottom of the elastomeric element 4 is fixed on the conductive membrane 5. An open trench 42 is formed in the top surface of the elastomeric element 4. The asterisk convex part 24 of the keycap 2 is accommodated within the open trench 42. As such, the elastomeric element 4 is stably fixed on the keycap 2 and the conductive membrane 5. Of course, the bottom of the elastomeric element 4 may be positioned on the conductive membrane 5. The base plate 6 is disposed under the conductive membrane 5. The key frame 1 is fixed with respect to the base plate 6.

Figure 7:
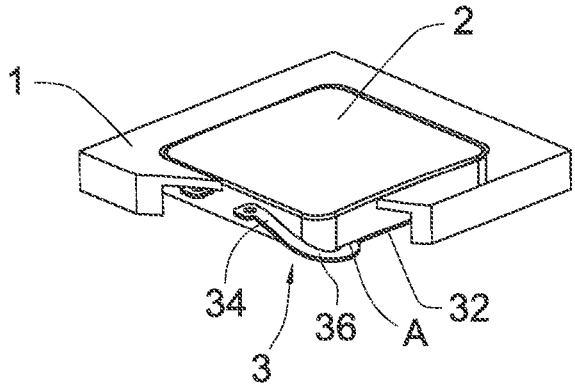
FIG. 7 is a schematic cutaway view illustrating an assembled depressible key structure according to the first embodiment of the present invention that has been depressed.

As shown in FIG. 6, in a case that the keycap 2 is not depressed, the outer movable arm parts 34 and the corner transition parts 36 of the elastic arms 3 are not subject to deformation. As shown in FIG. 7, in a case that the keycap 2 has been depressed, the intersection A between the elastic arms 3 and the periphery of the keycap 2 is suppressed by the keycap 2 to move downwardly. As a consequence, the outer movable arm parts 34 and the corner transition parts 36 of the elastic arms 3 are subject to deformation. In addition, the four outer corner portions 201 of the keycap 2 are suppressed to be respectively confined within the four corner transition parts 36 of the elastic arms 3. At the same time, the downward force is transformed into stable forces perpendicular to the keycap 2 by the four corner transition parts 36, so that the downward force is not biased. As the elastomeric element 4 is moved downwardly to touch the conductive membrane 5, the conductive membrane 5 is triggered to generate an electronic signal, thereby executing a key's function. In a case that the downward force exerted on the keycap 2 is eliminated, an elastic restoring force is provided by the elastic arms 3 and the elastomeric element 4. Due to the elastic restoring force, the keycap 2 is returned to its original position.

In the above embodiment, the supporting points at the four corners of the depressible key structure 100 are stripe-shaped. That is, the four corner transition parts 36 of the elastic arms 3 are protruded out of respective sides of the bottom surface of the keycap 2 to adjacent sides along the corresponding outer corner portions 201. Due to the stripe-shaped elastic arms 3, the four corners of the depressible key structure 100 have respective supporting points. Since the supporting forces acting on the four corners of the depressible key structure 100 are substantially identical, the downward force is transformed into stable forces when the keycap 2 is depressed. In addition, due to the stripe-shaped elastic arms 3, the downward force is readily transmitted to the middle portion of the depressible key structure 100 and the possibility of biasing the downward force is minimized. Under this circumstance, the depressing action is placed in the right position more precisely, and the tactile feel is more satisfactory.

Moreover, since the scissors-type support member used in the conventional key structure is replaced by the two identical elastic arms 3, the depressible key structure 100 of the present invention has reduced number of components and simplified configurations and is easily assembled. In addition, the fabricating cost of the components and associated moldings will be reduced. Since no scissors-type support member is used, the limitations of forming the scissors-type support member according to the plastic molding technology will no longer become hindrance from reducing the overall height of the key structure.

Figure 8:
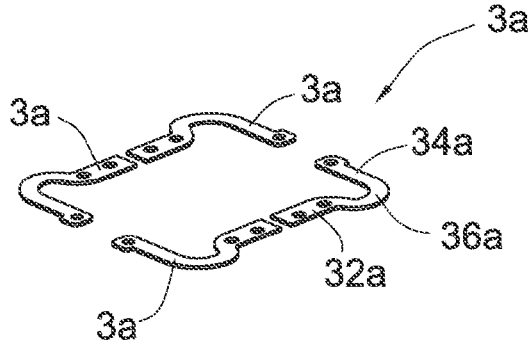
FIG. 8 is a schematic view illustrating the elastic arms used in a depressible key structure according to a second embodiment of the present invention.

FIG. 8 is a schematic view illustrating the elastic arms used in a depressible key structure according to a second embodiment of the present invention. In this embodiment, the inner fixed arm part 32 is separated into the segments. Each elastic arm 3*a* includes an inner fixed arm part 32*a*, an outer movable arm part 34*a* perpendicular to the inner fixed arm part 32*a*, and a corner transition part 36*a* interconnected between the inner fixed arm part 32*a* and the outer movable arm part 34*a*. The inner fixed arm part 32*a* is positioned or fixed on a specified side of the bottom surface of the keycap 2. The corner transition part 36*a* is protruded out of the specified side to an adjacent side along a corresponding outer corner portion 201. In this embodiment, the number of the elastic arms 3*a* is equal to the number of the outer corner portions 201 of the keycap 2.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A depressible key structure, comprising:

a key frame having a receiving hole a keycap accommodated within said receiving hole, and comprising plural outer corner portions; and plural elastic arms, wherein each of said elastic arms includes an inner fixed arm part, at least one outer movable arm part, and a corner transition part interconnected between said inner fixed arm part and said at least one outer movable arm part, wherein said corner transition parts of said elastic arms correspond to respective outer corner portions of said keycap, each of said inner fixed arm parts is positioned at an inner edge of a specified side of a bottom surface of said keycap, a corresponding corner transition part is protruded out of said specified side to an adjacent side along a corresponding outer corner portion, and said outer movable arm part is fixed on said key frame, wherein said keycap is square-shaped, and said depressible key structure comprises two elastic arms, wherein each of said elastic arms includes an inner fixed arm part, two outer movable arm parts disposed at bilateral sides of said inner fixed arm part and perpendicular to said inner fixed arm part, a first corner transition part interconnected between said inner fixed arm part and one outer movable arm part, and a second corner transition part interconnected between said inner fixed arm part and the other outer movable arm part, wherein said inner fixed arm parts of said two elastic arms are respectively positioned at inner edges of two opposite sides of said bottom surface of said keycap, and said outer movable arm parts of said two elastic arms are close to outer edges of corresponding sides of said bottom surface of said keycap.

2. The depressible key structure according to claim 1 wherein distal ends of said two outer movable arm parts at the same side are spaced from each other by a spacing interval.

3. The depressible key structure according to claim 1 wherein a middle retaining hole and two lateral retaining holes are formed in said inner fixed arm part of each elastic arm, and a middle retaining post and two lateral retaining posts are formed on said bottom surface of said keycap at said side corresponding to said inner fixed arm part, wherein said middle retaining hole and said lateral retaining holes are respectively engaged with said middle retaining post and said lateral retaining posts.

4. The depressible key structure according to claim 1 wherein a fret slot not running through a top surface of said key frame is extended from an outer periphery of said receiving hole and formed in a bottom of said key frame, a slot wall is defined at a backside of said top surface of the key frame, and distal ends of said outer movable arm part are fixed on said slot wall.

5. The depressible key structure according to claim 1 wherein said elastic arms are flat and stripe-shaped.

6. The depressible key structure according to claim 1 wherein from top to bottom, said depressible key structure further comprises an elastomeric element, a conductive membrane and a base plate, wherein a recess is formed in a middle and backside of said keycap, a bottom of said elastomeric element is disposed on said conductive membrane, a top of said elastomeric element is positioned in a middle of said recess, and said key frame is fixed with respect to said base plate.

7. The depressible key structure according to claim 6 wherein said elastomeric element is a rubbery depressible body.

8. The depressible key structure according to claim 7 wherein an asterisk convex part is formed on said middle of said recess, an open trench is formed in said top of said elastomeric element, and said asterisk convex part is accommodated within said open trench.

9. The depressible key structure according to claim 6 wherein said bottom of said elastomeric element is fixed on said conductive membrane.

* * * * *